US011421896B1

(12) United States Patent
McCain

(10) Patent No.: US 11,421,896 B1
(45) Date of Patent: Aug. 23, 2022

(54) RETURN TEE FOR HOT WATER RECIRCULATION SYSTEM

(71) Applicant: Eric McCain, Mountain Brook, AL (US)

(72) Inventor: Eric McCain, Mountain Brook, AL (US)

( * ) Notice: Subject to any disclaimer, the term of this patent is extended or adjusted under 35 U.S.C. 154(b) by 172 days.

(21) Appl. No.: 16/745,528

(22) Filed: Jan. 17, 2020

Related U.S. Application Data

(60) Provisional application No. 62/801,303, filed on Feb. 5, 2019, provisional application No. 62/793,865, filed on Jan. 17, 2019.

(51) Int. Cl.

| | |
|---|---|
| ***F24D 17/00*** | (2022.01) |
| ***F24H 1/10*** | (2022.01) |
| ***F24D 19/10*** | (2006.01) |
| ***F24D 3/08*** | (2006.01) |
| ***F24D 3/02*** | (2006.01) |

(52) U.S. Cl.
CPC ..... *F24D 17/0078* (2013.01); *F24D 3/02* (2013.01); *F24D 3/08* (2013.01); *F24D 17/0094* (2013.01); *F24D 19/1066* (2013.01); *F24H 1/101* (2013.01)

(58) Field of Classification Search
CPC ..... F24H 1/10; F24H 17/0078; F24H 3/02; F24H 3/08; F24H 17/0094; F24H 19/1066
See application file for complete search history.

(56) References Cited

U.S. PATENT DOCUMENTS 3,929,153 A 12/1975 Hasty
3,999,709 A * 12/1976 Estabrook ..... F24D 3/08 237/8 R
4,606,325 A * 8/1986 Lujan, Jr. ..... F24D 19/1051 122/13.3
4,750,472 A * 6/1988 Fazekas ..... F24D 19/1051 122/13.3

(Continued)

FOREIGN PATENT DOCUMENTS

WO WO2010103521 A2 9/2010
WO WO2018178483 A2 10/2018

OTHER PUBLICATIONS

Tank Booster Pro, Sales and Specifications Sheet, https://www.cashacme.com/cashacme/wp-content/uploads/2015/02/CA-Tank-Booster_Pro_USWholesale_SpecSheet_030116.pdf; Dec. 7, 2018.

*Primary Examiner* — Gregory A Wilson
(74) *Attorney, Agent, or Firm* — C. Brandon Browning; Maynard, Cooper & Gale, PC

(57) ABSTRACT

The present disclosure is directed to a hot water recirculation system with a return tee. The system includes a water heater, several supply lines, and a return tee. The hot water supply line is communicatively coupled to the water heater and at least one fixture and provides heated water from the water heater to the at least one fixture. The cold water supply line provides cold water from a cold water source to the water heater. Finally, the return line is communicatively coupled to the hot water supply line and delivers cooled water from the hot water supply line to the water heater. A return tee is communicatively coupled to the return line, the cold water supply line, and the water heater. This return tee provides cooled water from the return line and cold water from the cold water supply line to the water heater, which heats the water.

20 Claims, 2 Drawing Sheets

(56) References Cited

U.S. PATENT DOCUMENTS

| | | | | |
|---|---|---|---|---|
| 4,936,289 | A * | 6/1990 | Peterson | F24D 19/1054 122/13.3 |
| 5,105,846 | A | 4/1992 | Britt | |
| 5,351,712 | A | 10/1994 | Houlihan | |
| 5,518,022 | A | 5/1996 | Ziehm | |
| 5,735,291 | A | 4/1998 | Kaonohi | |
| 5,829,467 | A | 11/1998 | Spicher | |
| 6,041,819 | A | 3/2000 | Walleman | |
| 6,182,683 | B1 | 2/2001 | Sisk | |
| 6,349,736 | B1 * | 2/2002 | Dunmire | E03B 7/077 137/15.19 |
| 7,036,520 | B2 | 5/2006 | Pearson, Jr. | |
| 7,258,801 | B2 | 8/2007 | Ramirez et al. | |
| 8,316,886 | B2 * | 11/2012 | Olsen | F24D 3/1058 137/597 |
| 9,255,644 | B1 | 2/2016 | Voigt | |
| 9,863,647 | B1 | 1/2018 | Mcnamara et al. | |
| 10,215,445 | B1 * | 2/2019 | Mottershead | F24H 9/124 |
| 10,295,197 | B2 * | 5/2019 | Haws | E03B 7/045 |
| 2008/0265046 | A1 * | 10/2008 | Grimes | F24D 17/0078 237/19 |
| 2009/0145490 | A1 * | 6/2009 | Kershisnik | E03B 7/04 137/334 |
| 2010/0096018 | A1 * | 4/2010 | Wylie | F24H 1/122 137/2 |
| 2016/0265793 | A1 | 9/2016 | Copeland | |
| 2018/0172286 | A1 | 6/2018 | Abbing | |
| 2018/0195763 | A1 | 7/2018 | Sarkis, Sr. | |

* cited by examiner

RETURN TEE FOR HOT WATER RECIRCULATION SYSTEM

RELATED APPLICATIONS

This application claims priority to U.S. Provisional Patent Application No. 62/801,303 filed on Feb. 5, 2019, titled "Return Tee for Hot Water Recirculation System", the entire contents of which are incorporated herein. This application claims priority to U.S. Provisional Patent Application No. 62/793,865 filed on Jan. 17, 2019, titled "Return Tee for Hot Water Circulation", the entire contents of which are incorporated herein.

TECHNICAL FIELD

The present invention is directed to a hot water recirculation system with a return tee and methods of recirculating water through a return tee for optimal water heating.

BACKGROUND OF THE INVENTION

Water provided to a fixture is often desired to be heated to a temperature greater than that generally provided by a cold water line. Thus, a heating element, such as a water heater, is often utilized to increase the temperature of water from a cold water line before it is provided to the fixture. The heated water may be stored after heating by the heating element until it is needed, or water may be heated as needed without a heated water storage system.

In many cases, there exists an area of piping in which heated water is transported from a heated water source to the fixture. When the fixture is in use, water flows through this heated water line, and while the fixture is not in use, water may remain relatively confined within this heated water line. Often, the period of non-use of the fixture is such that heated water confined within the heated water line loses significant amount of heat through convection or other means. In these cases, re-initiation of fixture use may result in water that is initially provided at a temperature below the desired temperature.

The present invention provides a hot water recirculation means and method that allows not only the heating of cold water from a cold water source, but also the re-heating of previously heated water that had been left dormant in a heated water line during periods of fixture non-use. Using this system and method, the water temperature at a fixture is better aligned with the desired temperature.

SUMMARY OF THE INVENTION

The present invention is directed to a hot water recirculation system and methods of using a recirculation system, including a return tee, to provide hot water. In one aspect of the invention, there is provided a hot water recirculation system. The system includes a water heater configured to heat water to a desired temperature, a hot water supply line communicatively coupled to the water heater and at least one fixture and configured to provide heated water from the water heater to the at least one fixture, a cold water supply line configured to provide cold water from a cold water source to the water heater, a return line communicatively coupled to the hot water supply line and configured to deliver cooled water from the hot water supply line to the water heater, and a return tee communicatively coupled to the return line, the cold water supply line, and the water heater, and configured to provide cooled water from the return line and cold water from the cold water supply line to the water heater. Cooled water from the return line and cold water from the cold water supply line are delivered to the water heater and heated to the desired temperature, such that the heated water is provided at the desired temperature to at least one fixture instantaneously upon activating said fixture.

In some embodiments, the water heater further includes a recirculation pump configured to deliver heated water from the water heater, through the hot water supply line, to at least one fixture, and to deliver cooled water from the hot water supply line to the return line. The water heater further includes a heating provision configured to heat water and at least one sensor configured to detect the temperature of the water and provide water temperature data for controlling the heating provision in some instances. The water heater is powered by electricity or gas. In some embodiments, the water heater further includes an insulated tank configured to store heated water for future use. In these embodiments, the water heater further includes a dip tube and a heating provision, the dip tube configured to deliver cold water to be heated and the heating provision configured to heat the provided cold water. Also in these embodiments, the water heater may further include a thermostat configured to detect the temperature of heated water stored in the insulated tank.

According to another aspect of the present invention, there is provided a return tee system including a cold water supply line configured to supply cold water from a cold water source to a water heater and a cold line integrated check valve communicatively coupled to the cold water supply line such that cold water enters the cold water supply line from the cold water source and exits the cold water supply line through the cold line integrated check valve, the cold water integrated check valve configured to prevent reverse flow of water into the cold water supply line. Also included in the system are a return line configured to recirculate cooled, previously-heated water from a hot water supply line to the water heater and a return line integrated check valve communicatively coupled to the return line such that cooled water enters the return line from the hot water supply line and exits the return line through the return line integrated check valve, the return line integrated check valve configured to prevent reverse flow of water into the return line. Further included in the system are a cold water supply inlet communicatively coupled to the water heater and configured to deliver cold and cooled water to said water heater, and a return tee communicatively coupled to the cold line integrated check valve, the return line integrated check valve, and the cold water supply inlet, and configured to provide cold water from the cold water supply line and cooled water from the return line to the cold water supply inlet. Cold water enters the return tee from the cold water supply line through the cold line integrated check valve and cooled water enters the return tee from the return line and through the return line integrated check valve, and cold and cooled water enter the water heater from the return tee through the cold water supply inlet.

In some embodiments, the cold line integrated check valve and the return line integrated check valve are spring check valves with a spring, a stopper, and a valve seat. In some embodiments, the system further includes an integrated shut-off valve located between and communicatively coupled to the return line and the return line integrated check valve, the integrated shut-off valve configured to permit flow of cooled water from the return line to the return line integrated check valve when flow within the integrated shut-off valve is unobstructed and to at least partially prevent the flow of cooled water from the return line to the return line integrated check valve when flow within the integrated shut-off valve is at least partially obstructed. In these embodiments, the integrated shut-off valve further includes a handle configured to toggle said integrated shut-off valve through a fully open, fully closed, and intermediate position, such that the flow of cooled water is unobstructed in the fully open position, fully obstructed in the fully closed position, and at least partially obstructed in the intermediate position. The system may further include an integrated purge valve integrated proximate the integrated shut-off valve and configured to remove trapped air from the cooled water.

According to yet another aspect of the present invention, there is provided a method for supplying hot water. The method first includes the step of providing a hot water recirculation system including a water heater configured to heat water to a desired temperature, a hot water supply line communicatively coupled to the water heater and at least one fixture and configured to provide heated water from the water heater to the at least one fixture, a cold water supply line configured to provide cold water from a cold water source to the water heater, a return line communicatively coupled to the hot water supply line and configured to deliver cooled water from the hot water supply line to the water heater, and a return tee communicatively coupled to the return line, the cold water supply line, and the water heater, and configured to provide cooled water from the return line and cold water from the cold water supply line to the water heater. Next, at least one fixture is activated to produce water heated to a desired temperature. After activation of the at least one fixture, cooled water from the hot water supply line is recirculated through the return line and to the water heater when cooled water is at a temperature less than the desired temperature. Also upon activation of the at least one fixture, cold water is delivered from the cold water supply line to the water heater. Finally, the water heater heats water to the desired temperature and heated water is dispensed from the water heater, through the hot water supply line, and to the at least one fixture such that the heated water is provided at the desired temperature to the at least one fixture instantaneously upon activating said fixture. Deactivation of the at least one fixture ceases the delivery of heated water to the at least one fixture.

In some embodiments, the water heater further includes a recirculation pump configured to deliver heated water from the water heater, through the hot water supply line, to at least one fixture, and to deliver cooled water from the hot water supply line to the return line. In some embodiments, the water heater further includes a heating provision configured to heat water and at least one sensor configured to detect the temperature of the water and provide water temperature data for controlling the heating provision. Heating of water at the water heater is powered by electricity or gas. In some embodiments, the water heater further includes an insulated tank configured to store heated water. In these embodiments, the temperature of the stored water is detected within the insulated tank using a thermostat and the stored water is heated to maintain the stored water at the desired temperature.

BRIEF DESCRIPTION OF THE DRAWINGS

The present disclosure can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

Hot water recirculation systems are configured to supply hot water instantaneously, to the fixtures (such as faucets) in a facility (such as homes, office buildings etc.). The present invention corresponds to a return tee system 101 for a hot water recirculation system 100. In a particular embodiment, return tee system 101 is configured to assist in the recirculation of water in these systems 100. Further, in the depicted embodiment, return tee system 101 may be integrated as a single unit. Furthermore, the depicted embodiment may occupy less space, help avoid the potential leaks in system 100 and save installation costs.

Figure 1:
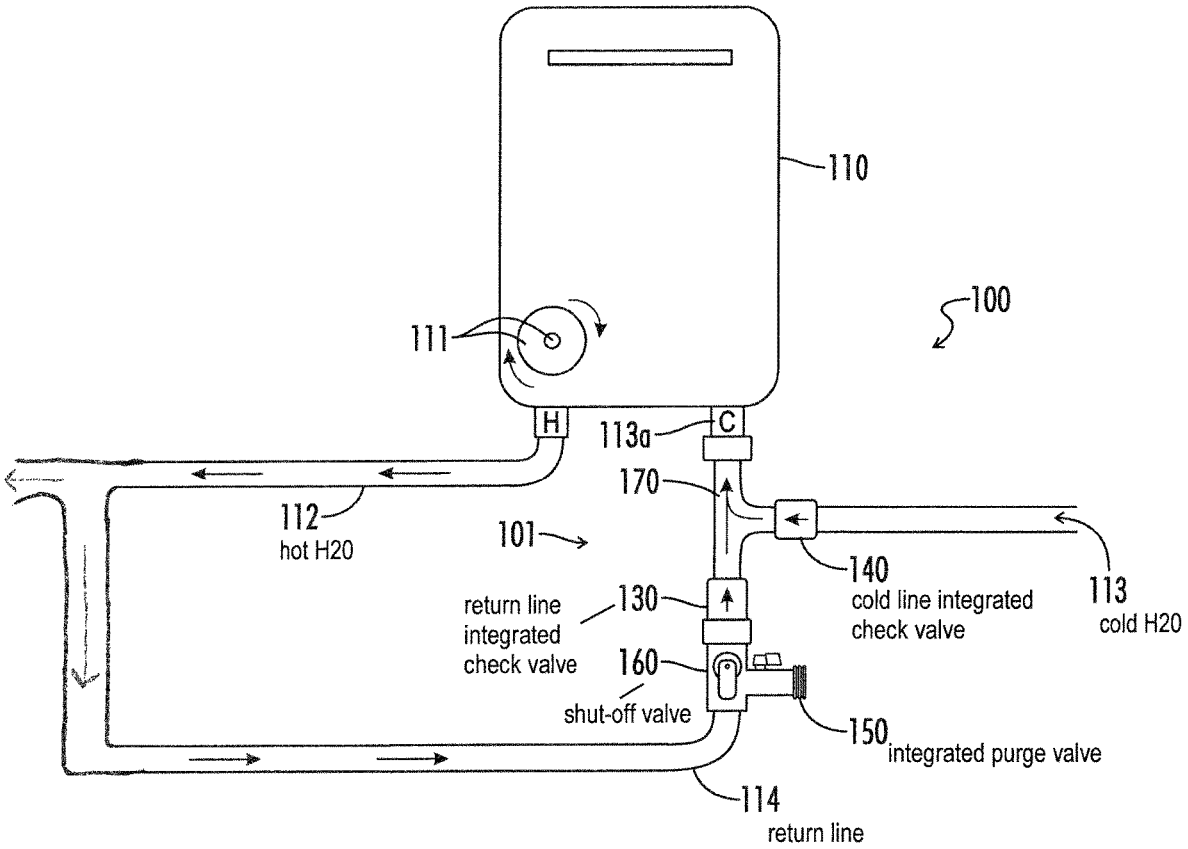
FIG. 1 depicts a hot water recirculation system with a return tee system.

FIG. 1 depicts hot water recirculation system 100, which comprises a water heater 110 with a recirculation pump 111, return tee system 101, one or more fixtures (e.g., faucet) (not shown in FIG. 1) and a plurality of lines including at least one line 112 for the hot water supply (referred to as hot water supply line 112), at least one line 113 for the cold water supply (referred to as cold water supply line 113) and at least one other line for a return line 114.

In an exemplary embodiment, when a fixture is not in use, the hot water staying in hot water supply line 112 often loses heat energy over time due to convective heat transfer, and has reduced temperature relative to the temperature that is desired to be delivered at the fixture. Further, in such an embodiment, to deliver hot water immediately when a fixture is operated again, the relatively cold water now (cold relative to the temperature of water that is desirable at the fixtures) available in hot water supply line 112 is driven back to heater 110 to heat the water to the desired temperature. Return line 114 is communicatively coupled to hot water supply line 112 and is configured to deliver relatively cold water available in hot water supply line 112 back to heater 110 through return tee system 101.

Water heater 110, along with built-in recirculation pump 111, is configured to heat the water and deliver hot water to the fixture. Heater 110 is communicatively coupled to hot water supply line 112 and a cold water supply inlet 113*a*, wherein heater 110 is in fluid communication with hot water supply line 112 and cold water supply inlet 113*a*. Heater 110 is configured to receive cold water through cold water supply inlet 113*a*. Further, heater 110 is configured to heat the received cold water to a desired temperature, such that heated water is supplied through to the fixtures using hot water supply line 112.

In an exemplary embodiment, as depicted by FIG. 1, water heater 110 is a tank-less water heater comprising a heating provision (e.g., a heat exchanger or an electric heating element) (not shown in FIG. 1) and at least a sensor (not shown in FIG. 1). As water from cold water supply inlet 113*a* flows into heater 110, the sensor is, in some instances, configured to activate the heating provision. Further, water is heated as it passes through the heating provision and is delivered to the fixtures through hot water supply line 112. Furthermore, the heating provision is, in some instances, activated immediately when hot water is required and stays activated as long as hot water is required. Aforementioned tank-less water heater 110 thus potentially saves installation space by eliminating the usage of storage tanks to store hot water, and saves energy and energy related cost by activating only when there is a necessity for hot water. Further, in the depicted embodiment, there is no loss or a minimal loss in heat energy of hot water delivered from heater 110. In some embodiments, water heater 110 is powered by electricity. In some embodiments, water heater 110 is powered by gas.

In some embodiments, water heater 110 is a tank-type water heater. The tank type water heater 110 includes an insulated tank (not shown in FIG. 1), a dip tube (not shown in FIG. 1), and a tank heating provision (not shown in FIG. 1), wherein the dip tube is configured to deliver cold water from cold water supply inlet 113*a*, the tank heating provision is required to heat the water delivered by the dip tube, and the insulated tank stores the heated water for future use. As cold water is supplied into heater 110 through cold water supply inlet 113*a* and the dip tube, cold water gets heated by the tank heating provision, stored in the insulated tank, and stored hot water in the insulated tank is delivered through hot water supply line 112. Heater 110, in such embodiments, also includes a thermostat (not shown in FIG. 1), to detect the temperature of water stored in the insulated tank wherein, in such embodiments, the stored water in the insulated tank is heated to be maintained at the desired temperature whenever the temperature of water decreases below a predetermined value. In some embodiments, water heater 110 is powered by electricity. In some embodiments, water heater 110 is powered by fuel. In such embodiments, installation of water heater 110 is easy and initial installation cost is potentially decreased relative to installation of other systems. Further, in such embodiments, the operation is simple and thereby requires low-cost repairs in case of malfunction. In other embodiments, other types of water heaters 110 are possible.

Recirculation pump 111 is configured to pump the water in system 100, wherein pump 111 drives the relatively cold water available at hot water supply line 112 to heater 110 through return line 114 (and further to cold water supply inlet 113*a*), as is depicted by FIG. 1, such that the cold water gets heated at heater 110 and pump 111 is configured to deliver the heated water from heater 110 to the fixture through hot water supply line 112. In some embodiments, pump 111 is configured to deliver hot water continuously. In some embodiments, pump 111 is configured to pump water periodically. In some embodiments, pump 111 delivers hot water when the water in the hot water pipe line falls below a set temperature. However, in other embodiments, other kinds of arrangements of pump 111 are possible.

Return tee system 101 is coupled to return line 114 and cold water supply lines 113, inlet 113*a*, such that return tee system 101 is in fluid communication with return line 114 and cold water supply lines 113, inlet 113*a*. Return tee system 101 is configured to assist in the delivery of relatively cold water from return line 114 and cold water from line 113, to cold water supply inlet 113*a*. Return tee system 101 includes a plurality of integrated check valves, including at least a return line integrated check valve 130 for return line 114 and at least a cold line integrated check valve 140 for cold water supply line 113. System 101 further includes an integrated purge valve 150, an integrated shut-off valve 160 and a tee 170. In return tee system 101, integrated shut-off valve 160 is configured to be coupled with return line 114. Return line integrated check valve 130 is integrated to integrated shut-off valve 160. Furthermore, integrated purge valve 150 is integrated proximate integrated shut-off 160. Cold line integrated check valve 140 is configured to be coupled with cold water supply line 113 and tee 170 is integrated with the integrated check valves 130, 140 and further configured to be coupled with cold water supply inlet 113*a*. In the depicted embodiment, return tee system 101 is integrated together as a single unit. However, in other embodiments, other arrangements of return tee system 101 are possible.

In system 100, water from cold water supply line 113 flows through cold line integrated check valve 140 of return tee system 101. Further, re-circulation pump 111, on activation, pumps the relatively cold water from return line 114 through integrated shut-off 160 and return line integrated check valve 130 of return tee system 101. Return tee system 101 further couples the flow of water from return line 114 and cold water supply line 113 at tee 170 and delivers the water to cold water supply inlet 113*a*. Further, in some embodiments, when the water in return line 114 reaches the desired temperature, the flow from return line 114 is shut-off until the temperature of water in hot water supply line 112 or return line 114 drops below the desired temperature of water required at the fixture. In some embodiments, the water from return line 114 is shut-off periodically (after a set period of time). However, in other embodiments, other configurations are possible.

Figure 2:
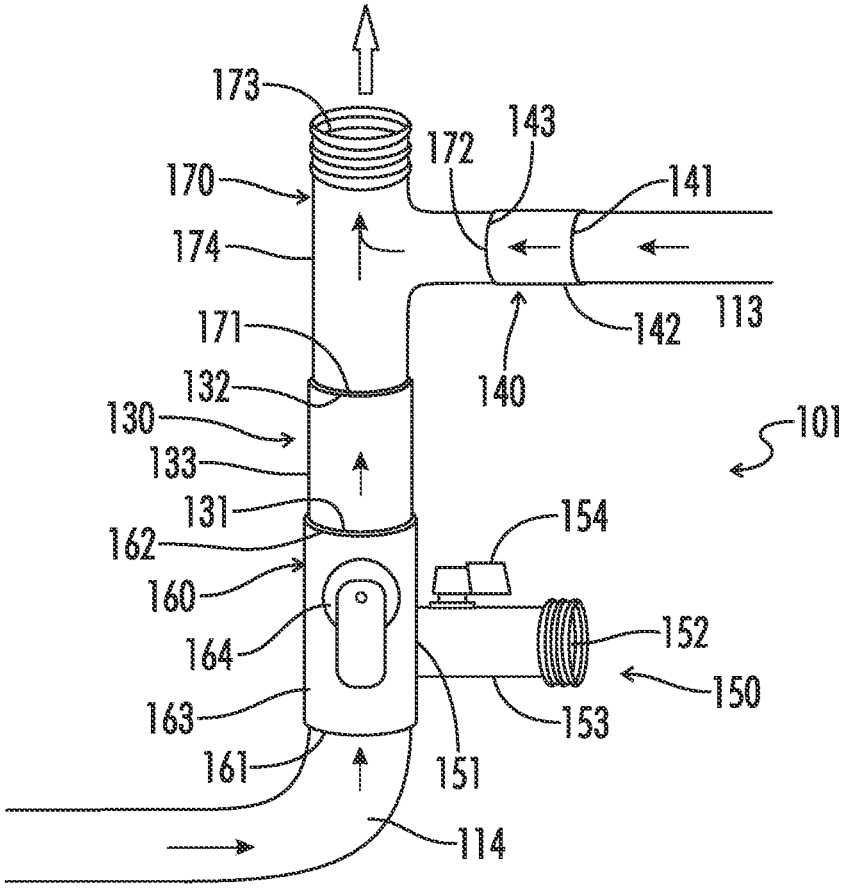
FIG. 2 depicts an exemplary embodiment of the return tee system, as depicted in FIG. 1.

FIG. 2 depicts an exemplary embodiment of return tee system 101. Referring to the FIG. 1 and FIG. 2, integrated shut-off valve 160 comprises a shut-off inlet 161, a shut-off outlet 162, a shut-off body 163 and a shut-off handle 164. Shut-off inlet 161 is configured to be coupled with return line 114, such that integrated shut-off valve 160 is in fluid communication with return line 114, such that the water from return line 114 enters the integrated shut-off valve 160 through shut-off inlet 161, runs through shut-off body 163 and leave through shut-off outlet 162 of integrated shut-off valve 160, as depicted by directional arrow mark in FIG. 2. Further, in the depicted embodiment, integrated shut-off valve 160 allows the flow of water through integrated shut-off valve 160 unless the flow is obstructed at shut-off body 163 of integrated shut-off valve 160. Shut-off handle 164 is configured to assist the shut-off of the flow through integrated shut-off valve 160 and is configured to toggle integrated shut-off valve 160 through a fully open position and a fully closed position. The fully open position is defined as the position of integrated shut-off valve 160 which allows full flow of water entering integrated shut-off valve 160 at shut-off inlet 161 and running through shut-off body 163, to be available at shut-off outlet 162 of integrated shut-off valve 160. The fully closed position is defined as position of integrated shut-off valve 160 wherein full flow of water entering integrated shut-off valve 160 at shut-off inlet 161 is completely shut-off in shut-off body 163, such that the water flow may not be available at shut-off outlet 162 of integrated shut-off valve 160. In some embodiments, integrated shut-off valve 160 is toggled between the fully open position and the fully closed position, resulting in a partially open position (wherein partial flow of water is allowed through shut-off body 163 of integrated shut-off valve 160, such that partial flow of water is available at shut-off outlet 162). In the depicted embodiment, integrated shut-off valve 160 includes standard ¾" female iron pipe threading in the interior of shut-off inlet 161, to enable coupling with return line 114. However, in other embodiments, other kinds of integrated shut-off valves 160 with other configurations and other coupling mechanisms are possible.

Trapped air molecules in the system 100 potentially cause disturbances and obstruct the flow in system 100. Further, in some embodiments, trapped air molecules in system 100 create issues with recirculation pump 111 and potentially prevent recirculation pump 111 from properly functioning. In the depicted embodiment, purge valve 150 is configured to remove trapped air molecules from system 100. Purge valve 150 is comprises a purge inlet 151, a purge outlet 152, a purge body 153 and a purge handle 154. Purge inlet 151 of purge valve 150 is integrated proximate integrated shut-off valve 160. Purge valve 150 includes standard ¾" female iron pipe threading to the interior of purge outlet 152 of purge valve 150, to enable coupling with other components of system 100. In an exemplary embodiment, purge outlet 152 of purge valve 150 is configured to be coupled with a hose bib. However, in other embodiments, other kinds of arrangements of purge valve 150 and other coupling mechanisms are possible.

Return line integrated check valve 130 on return line 114 comprises a return check inlet 131, a return check outlet 132 and a return check body 133. Return check inlet 131 is integrated to shut-off outlet 162 of integrated shut-off valve 160. Return line integrated check valve 130 is in fluid communication with integrated shut-off valve 160, such that the water from shut-off outlet 162 of integrated shut-off valve 160 enters the return line integrated check valve 130 through return check inlet 131, runs through return check body 133, and leaves through return check outlet 132 of return line integrated check valve 130, as depicted by directional arrow mark in FIG. 2. Return line integrated check valve 130 prevents reverse flow in some instances, such that the water from return tee system 101 is prevented from flowing back into return line 114. Further, in such an embodiment, a spring check valve is used, wherein return check body 133 of return line integrated check valve 130 includes a spring (not shown in FIG. 2), a stopper (not shown in FIG. 2) and a valve seat (not shown in FIG. 2) to assist in allowing the flow of water through return line integrated check valve 130 and assist in preventing the reverse flow. However, in other embodiments, other kinds of integrated check valves are potentially used.

Cold line integrated check valve 140 on cold water supply line 113 comprises a cold check inlet 141, a cold check body 142 and a cold check outlet 143. Cold check inlet of cold line integrated check valve 140 is configured to be communicatively coupled to cold water supply line 113, such that cold line integrated check valve 140 is in fluid communication with cold water supply line 113. Further, the water from cold water supply line 113 enters cold line integrated check valve 140 through cold check inlet 141, runs through cold check body 142, and leaves through cold check outlet 143 of cold line integrated check valve 140, as depicted by the directional arrow mark in FIG. 2. Further, in the depicted embodiment, cold line integrated check valve 140 prevents reverse flow in some instances, such that the water from return tee system 101 is prevented from flowing back into cold water supply line 113 water flow. In an exemplary embodiment as depicted, a spring check valve is used, wherein cold check body 142 of cold line integrated check valve 140 includes a spring (not shown in FIG. 2), a stopper (not shown in FIG. 2) and a valve seat (not shown in FIG. 2) to assist flowing water through cold line integrated check valve 140 and assist in preventing reverse flow. Furthermore, the cold line integrated check valve 140 includes, in some instances, standard ¾" female iron pipe threading to the interior of cold check inlet 141 to enable coupling with cold water supply line 113. However, in other embodiments, other kinds of cold line integrated check valves 140 with other configurations and other coupling mechanisms are potentially used.

Tee 170 is configured to couple the flow of water from cold water supply line 113 and return line 114 and discharge the flow into cold water supply inlet 113*a*. Tee 170 includes one or more inlets (e.g., first tee inlet 171 and second tee inlet 172), a tee outlet 173 and a tee body 174. Tee 170 is in fluid communication with the return line integrated check valve 130 on return line 114, cold line integrated check valve 140 on cold water supply line 113 and cold water supply inlet 113*a*. Further, in the depicted embodiment, return check outlet 132 of return line integrated check valve 130 is integrated to first tee inlet 171 of tee 170, and cold check outlet 143 of cold line integrated check valve 140 is integrated with second tee inlet 172 of tee 170. Tee outlet 173 of tee 170 is configured to be communicatively coupled with cold water supply inlet 113*a*.

In the depicted embodiment, as represented by the directional arrow marks, cold water from cold water supply line 113 runs from cold line integrated check valve 140 through second tee inlet 172 of tee 170 and water from return line 114 flows from return line integrated check valve 130 through first tee inlet 171 of tee 170. The flows from return line 114 and cold water supply line 113 entering through tee inlets 171, 172 are joined at and run through tee body 174 of tee 170. Further, the aforementioned flow of water is delivered to cold water supply inlet 113*a* through tee outlet 173 of tee 170. Furthermore, in the depicted embodiment, to enable coupling of tee 170 with cold water supply inlet 113*a*, standard ¾" male iron pipe threading is available on the outer side of tee outlet 173. In other embodiments, other configurations of tee 170 and other coupling mechanisms are possible.

As will be apparent to one skilled in the art, various modifications can be made within the scope of the aforesaid description. Such modifications being within the ability of one skilled in the art form a part of the present invention and are embraced by the claims below. For example, the present invention may be used with tanks or tank-less with external recirculation systems.

I claim:

1. A hot water recirculation system comprising:

a water heater configured to heat water;

a hot water supply line communicatively coupled to the water heater and at least one fixture and configured to provide heated water from the water heater to the at least one fixture;

a cold water supply line configured to provide cold water from a cold water source to the water heater;

a return line communicatively coupled to the hot water supply line and configured to deliver cooled water from said hot water supply line to the water heater; and a return tee communicatively coupled to the return line, the cold water supply line, and the water heater, and configured to provide cooled water from the return line and cold water from the cold water supply line to the water heater, the return tee including a cold line integrated check valve through which only cold water from the cold water source flows and a return line integrated check valve whereby the cold line integrated check valve, the return line integrated check valve and the return tee form an integrated single unit;

wherein cooled water from the return line and cold water from the cold water supply line are delivered to the water heater and heated, such that the heated water is provided to at least one fixture instantaneously upon activating said fixture.

2. The hot water recirculation system of claim 1, wherein the water heater further comprises a recirculation pump configured to deliver heated water from the water heater, through the hot water supply line, to at least one fixture, and to deliver cooled water from the hot water supply line to the return line.

3. The hot water recirculation system of claim 1, wherein the water heater further comprises a heating provision configured to heat water and at least one sensor configured to detect the temperature of the water and provide water temperature data for controlling the heating provision.

4. The hot water recirculation system of claim 1, wherein the water heater further comprises an insulated tank configured to store heated water for future use.

5. The hot water recirculation system of claim 4 wherein the water heater further comprises a dip tube and a heating provision, the dip tube configured to deliver cold water to be heated and the heating provision configured to heat the provided cold water.

6. The hot water recirculation system of claim 1, wherein the single unit includes an integrated purge valve and proximate thereto a cut-off valve.

7. A return tee system comprising:

a cold water supply line configured to supply cold water from a cold water source to a water heater;

a cold line integrated check valve communicatively coupled to the cold water supply line such that cold water only enters the cold water supply line from the cold water source and only cold water exits the cold water supply line through the cold line integrated check valve, said cold water integrated check valve configured to prevent reverse flow of water into the cold water supply line;

a return line configured to recirculate cooled, previously-heated water from a hot water supply line to the water heater;

a return line integrated check valve communicatively coupled to the return line such that cooled water enters the return line from the hot water supply line and exits the return line through the return line integrated check valve; said return line integrated check valve configured to prevent reverse flow of water into the return line;

a cold water supply inlet communicatively coupled to the water heater and configured to deliver cold and cooled water to said water heater; and a return tee communicatively coupled to the cold line integrated check valve, the return line integrated check valve, and the cold water supply inlet, and configured to provide cold water from the cold water supply line and cooled water from the return line to the cold water supply inlet;

wherein the cold line integrated check valve, the return line integrated check valve, and the return tee form a single integrated unit and wherein cold water enters the return tee from the cold water supply line through the cold line integrated check valve and cooled water enters the return tee from the return line and through the return line integrated check valve, and wherein cold and cooled water enter the water heater from the return tee through the cold water supply inlet.

8. The return tee system of claim 7 wherein the cold line integrated check valve is a spring check valve comprising a spring, a stopper, and a valve seat.

9. The return tee system of claim 7 wherein the return line integrated check valve is a spring check valve comprising a spring, a stopper, and a valve seat.

10. The return tee system of claim 7 further comprising an integrated shut-off valve located between and communicatively coupled to the return line and the return line integrated check valve, the integrated shut-off valve configured to permit flow of cooled water from the return line to the return line integrated check valve when flow within the integrated shut-off valve is unobstructed and to at least partially prevent the flow of cooled water from the return line to the return line integrated check valve when flow within the integrated shut-off valve is at least partially obstructed.

11. The return tee system of claim 10, wherein the integrated shut-off valve further comprises a handle configured to toggle said integrated shut-off valve through a fully open, fully closed, and intermediate position, such that the flow of cooled water is unobstructed in the fully open position, fully obstructed in the fully closed position, and at least partially obstructed in the intermediate position.

12. The return tee system of claim 10 further comprising an integrated purge valve integrated proximate the integrated shut-off valve and configured to remove trapped air from the cooled water.

13. A method for supplying hot water comprising the steps of:

providing a hot water recirculation system comprising a water heater configured to heat water, a hot water supply line communicatively coupled to the water heater and at least one fixture and configured to provide heated water from the water heater to the at least one fixture, a cold water supply line configured to provide cold water from a cold water source to the water heater, a return line communicatively coupled to the hot water supply line and configured to deliver cooled water from said hot water supply line to the water heater, and a return tee communicatively coupled to the return line, the cold water supply line, and the water heater, and configured to provide cooled water from the return line and cold water from the cold water supply line to the water heater, the return tee including a cold line integrated check valve through which only cold water from the a cold water source flows and a return line integrated check valve whereby the cold line integrated check valve, the return line integrated check valve and the return tee are integrated to form a single unit;

activating at least one fixture to produce heated water;

recirculating cooled water from the hot water supply line, through the return line, and to the water heater upon activation of the at least one fixture when cooled water is at a temperature less than a temperature of the heated water;

delivering cold water from the cold water supply line to the water heater upon activation of the at least one fixture;

heating water at the water heater; and dispensing heated water from the water heater, through the hot water supply line, and to the at least one fixture such that the heated water to the at least one fixture upon activating said fixture.

14. The method of claim 13, wherein the deactivation of the at least one fixture ceases the delivery of heated water to said at least one fixture.

15. The method of claim 13, wherein the water heater further comprises a recirculation pump configured to deliver heated water from the water heater, through the hot water supply line, to at least one fixture, and to deliver cooled water from the hot water supply line to the return line.

16. The method of claim 13, wherein the water heater further comprises a heating provision configured to heat water and at least one sensor configured to detect the temperature of the water and provide water temperature data for controlling the heating provision.

17. The method of claim 13, wherein heating of water at the water heater is powered by electricity or gas.

18. The method of claim 13, wherein the water heater further comprises an insulated tank configured to store heated water.

19. The method of claim 18, including detecting the temperature of the stored water within the insulated tank using a thermostat and heating the stored water to maintain the stored water.

20. The method of claim 13, including purging air from the hot water recirculation system using an integrated purge valve integrated into the single unit.

* * * * *